US007912415B2

(12) United States Patent
Shiozawa

(10) Patent No.: US 7,912,415 B2
(45) Date of Patent: Mar. 22, 2011

(54) IMAGE FORMING APPARATUS

(75) Inventor: Motohide Shiozawa, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 33 days.

(21) Appl. No.: 12/504,245

(22) Filed: Jul. 16, 2009

(65) Prior Publication Data

US 2010/0028064 A1 Feb. 4, 2010

(30) Foreign Application Priority Data

Jul. 31, 2008 (JP) ..... 2008-197157

(51) Int. Cl.
*G03G 15/20* (2006.01)

(52) U.S. Cl. ..... 399/341; 399/407

(58) Field of Classification Search ..... 399/302, 399/308, 320, 341, 342, 407
See application file for complete search history.

(56) References Cited

U.S. PATENT DOCUMENTS

| | | | | |
|---|---|---|---|---|
| 6,026,268 | A | 2/2000 | Shiozawa et al. | 399/297 |
| 6,049,681 | A | 4/2000 | Shiozawa et al. | 399/46 |
| 6,681,095 | B1 * | 1/2004 | Tsuda | 399/341 |
| 7,412,198 | B2 * | 8/2008 | Isemura et al. | 399/341 |
| 2007/0280759 | A1 | 12/2007 | Isemura et al. | 399/341 |

* cited by examiner

*Primary Examiner* — Hoan Tran
(74) *Attorney, Agent, or Firm* — Fitzpatrick, Cella, Harper & Scinto

(57) ABSTRACT

An image forming apparatus has a first toner image forming portion which forms a toner image at a recording material and heats the recording material at which the toner image is formed, a second toner image forming portion which forms a toner image at the recording material heated at the first toner image forming portion and heats the recording material to which the toner image is formed, and a preliminary heating member which heats the toner image on an image bearing member of the second image forming portion before the toner image is transferred to the recording material.

5 Claims, 7 Drawing Sheets

IMAGE FORMING APPARATUS

BACKGROUND OF THE INVENTION

1. Field of the Invention

The present invention relates to an image forming apparatus such as a copying machine, a printer, a facsimile machine, and a multifunction machine having plural functions thereof.

2. Description of the Related Art

An image forming apparatus of an electrophotographic system has been widely known in the related art. In addition to a monochrome type, a variety of image forming apparatuses which perform full-color image forming have been introduced to the market. Here, in accordance with extending of various usage areas of the image forming apparatuses, the need for improved image quality have been growing.

Adding varied gloss expression has been desired as one of factors to improve the image quality. Specifically, it is desired to mix a low glossiness part and a high glossiness part on a surface of an output product. For example, an image of character information (i.e., a document area) is finished in low glossiness for easy reading. On the other hand, a gradation image, such as a picture or an illustration (i.e., a graphics area), is finished in high glossiness for enhanced appearance. In addition, emphasized expression is performed by forming a high glossiness part partially in a gradation image.

In US2007/280759, glossiness of an image is adjusted by separately providing a clear image forming portion which forms a clear toner image in a conveying direction downstream from a recording material of a color image forming portion which forms a color toner image. Here, the color toner image is heated at both the color image forming portion and the clear image forming portion. On the other hand, the clear toner image is heated only at the clear image forming portion. Therefore, it is difficult to increase the glossiness of the area where the clear toner image is formed so as to be higher than that of the area where the clear toner image is not formed.

SUMMARY OF THE INVENTION

The present invention provides an image forming apparatus including a clear image forming portion for forming a clear toner image which is separately arranged in a recording material conveying direction downstream from a color image forming portion for forming a color toner image, so that an area where the clear toner image is formed can be finished at a desired glossiness.

Further, the present invention provides an image forming apparatus comprising: a first toner image forming portion which forms a toner image at a recording material and heats the recording material at which the toner image is formed; a second toner image forming portion which forms a toner image at the recording material heated at the first toner image forming portion and heats the recording material to which the toner image is formed, the second toner image forming portion including an image bearing member for bearing the toner image and a transfer member for transferring the toner image of the image bearing member to the recording material; and a preliminary heating member which heats the toner image on the image bearing member of the second toner image forming portion before a transferring operation of the transfer member.

Further features of the present invention will become apparent from the following description of exemplary embodiments with reference to the attached drawings.

DESCRIPTION OF THE EMBODIMENTS

First Embodiment

An image forming apparatus and an image forming method of the first embodiment according to the present invention are described with reference to the drawings.

Figure 1:
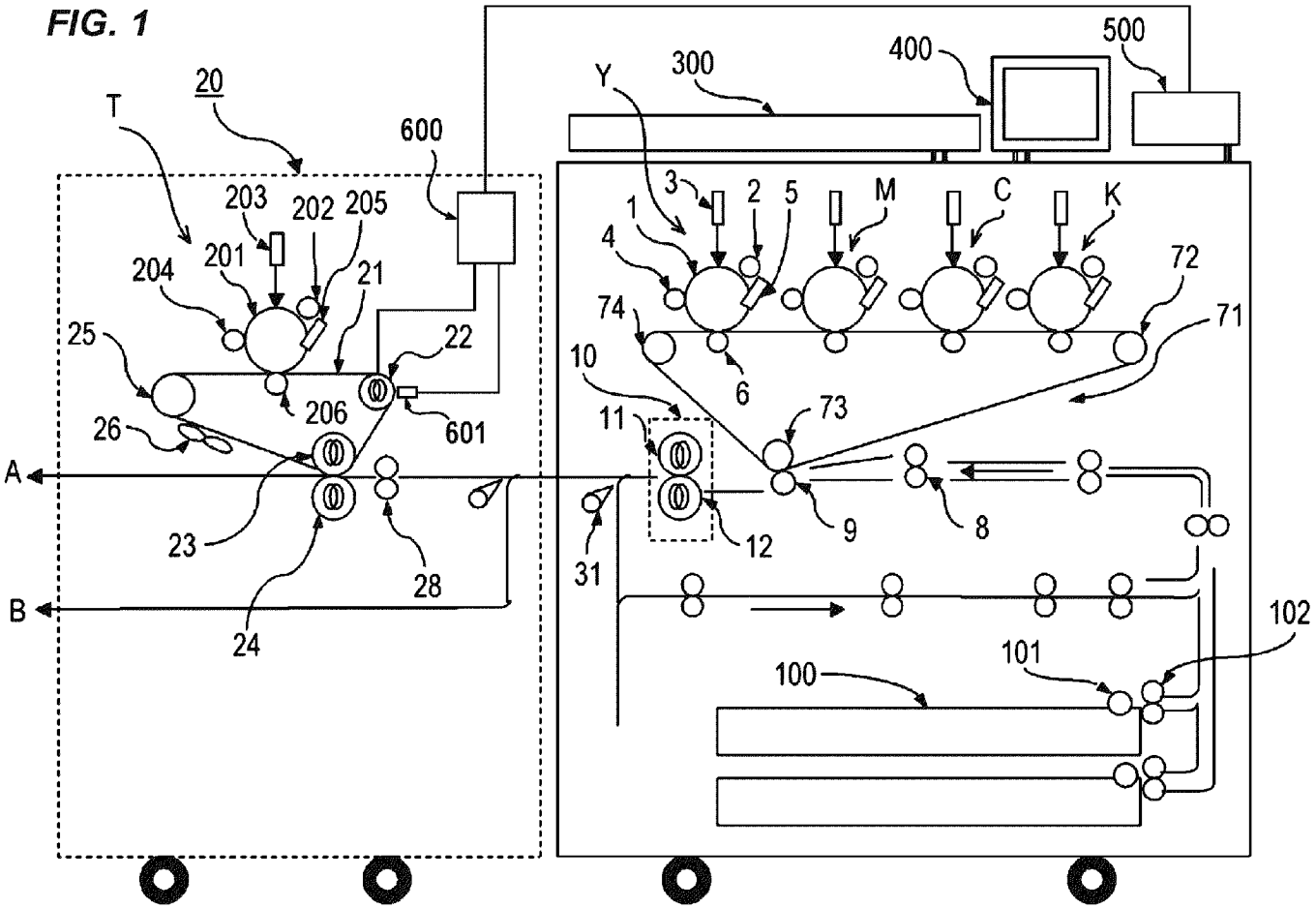
FIG. 1 is a configuration diagram of an image forming apparatus according to a first embodiment.

FIG. 1 is a configuration diagram of the image forming apparatus according to the present embodiment. As illustrated in FIG. 1, the image forming apparatus of the present embodiment is a color multifunction machine having a copying function and a printing function, and which was an intermediate transfer member.

A document reading device 300 for reading image information of a document to which the document to be copied is placed is provided at the top of the apparatus. The image information which is read by the document reading device 300 is subjected to an image process. A later-mentioned exposure unit is controlled in accordance with the image-processed data.

An operation portion 400 is provided beside the document reading apparatus 300. Selection and direction of a later-mentioned image forming mode is performed at the operation portion 400. A control unit (CPU) 500 controls later-mentioned image forming units, a fixing device 10 and a clear image forming apparatus 20.

Four image forming stations (i.e., first image forming means) Y, M, C and K are arranged in order to be approximately horizontal at the upper side in the apparatus. These image forming stations Y, M, C and K respectively form a yellow toner image, a magenta toner image, a cyan toner image and a black toner image as the first toner image. Here, the configurations of the image forming stations are approximately the same except for the color of the toner as developer.

In the following, the image forming station Y is described in detail. The image forming stations M, C and K are similar thereto. The toner of which glass transition temperature Tg is 65° C. is used.

A photoconductor (hereinafter, called a photosensitive drum) 1 is rotatably provided to the image forming station Y as an image bearing member. A charge roller (charge means) 2, the exposure unit (image exposure means) 3, a development device (development means) 4, a primary transfer roller (primary transfer means) 6 and a cleaner (cleaning means) 5 are arranged around the photosensitive drum 1.

Further, an intermediate transfer belt (an intermediate transfer member) 71 is rotatably provided so as contact to the photosensitive drum 1. The intermediate transfer belt 71 is looped over a driven roller 72, a secondary transfer counter roller 73 and a drive roller 74 which is driven by a drive motor. Then, a primary transfer roller 6 is provided at a position opposed to the photosensitive drum 1 while sandwiching the intermediate transfer belt 71. The driven roller 72 which also serves as a tension roller applies a predetermined tension to the intermediate transfer belt 71. The secondary transfer counter roller 73 is arranged at a position opposed to a later-mentioned secondary transfer roller 9 while sandwiching the intermediate transfer belt 71. Further, the secondary transfer counter roller 73 receives secondary transfer bias from a high voltage power supply at the time of the secondary transfer. The secondary transfer roller 9 and the secondary transfer counter roller 73 configure first transfer means.

Every image forming unit of the image forming apparatus is operated (i.e., rotated) at a processing speed of approximate 130 mm/sec. Here, the exposure scanning speed of the exposure unit 3 is set in accordance with the processing speed of the rotation of the photosensitive drum 1.

A cassette 100 which accommodates recording sheets is provided below the intermediate transfer belt 71. The recording sheets accommodated in the cassette 100 are separated and conveyed one by one by a pickup roller 101 and conveyed to a registration roller 8 via a plurality of pairs of conveying rollers 102. The registration roller 8 feeds the recording sheet so that the entry timing of a toner image on the intermediate transfer belt 71 to the secondary transfer portion and the entry timing of the recording sheet to the secondary transfer portion are matched.

Next, image forming operation of the image forming portion is described. First, the surface of the photosensitive drum 1 which rotates in a counterclockwise direction in FIG. 1 is evenly charged by the charge roller 2. Then, laser light is irradiated from the exposure unit 3 in accordance with an image signal and an electrostatic latent image is formed. Then, the electrostatic latent image is visualized with developer attached by the development device 4. The toner image formed at the photosensitive drum 1 is primarily transferred to the intermediate transfer belt 71 by applying primarily transfer bias to the primary transfer roller 6.

The same process up to the development step is performed at each of the image forming stations. Then, the toner image of each color is primarily transferred on the intermediate transfer belt 71 so as to be superimposed one another. Namely, the toner image of each color of yellow, magenta, cyan and black which is formed at each of the image forming stations is transferred on the intermediate transfer belt 71 while being superimposed so that a color image is formed.

Subsequently, the toner images on the intermediate transfer belt 71 are secondarily transferred collectively to a recording sheet which is introduced to the secondary transfer portion by applying secondary transfer bias to the secondary transfer counter roller 73.

The recording sheet P to which the toner images are transferred is conveyed to a clear image forming apparatus 20 after being processed to be fixed by a fixing device 10 or without being processed. Then, after a clear toner image is formed, the recording sheet P is discharged to the outside.

(Fixing Device)

The fixing device (fixing means) 10 is arranged downstream from the secondary transfer portion in the conveying direction of the recording sheet.

A fixing roller 11 serving as a fixing member and a pressure roller 12 serving as a nip forming member which forms a fixing nip by being pressed into contact with the fixing roller 11 are provided to the fixing device 10. The pressure between the fixing roller 11 and the pressure roller 12 is set to be 50 kg in total.

The fixing roller 11 has a configuration that a rubber layer as an elastic layer and a fluororesin layer as a toner parting layer are laminated on a core bar which is made of Al or Fe etc. Then, a halogen heater as a heating source is provided inside the core bar which is hollow. As the heating source, other types such as a so-called IH type which utilizes electromagnetic induction heating can also be used, for example.

Further, the fixing roller 11 is connected to a drive motor via a drive gear train and is rotated with the driving force of the drive motor.

Similar to the fixing roller 11, the pressure roller 12 has a configuration where a rubber layer serving as an elastic layer and a fluororesin layer serving as a toner parting layer are laminated on a core bar. Then, a halogen heater is provided inside the core bar which is hollow. As the heating source, other types such as a so-called IH type which utilizes electromagnetic induction heating can be also used, for example.

The pressure roller 12 is configured to be driven by the fixing roller 11 so as to be rotated with the fixing roller 11.

A thermistor is respectively provided at the vicinity of the surfaces of the fixing roller 11 and the pressure roller 12 as detection means which detects the temperature thereof. Powering to the halogen heaters which are respectively integrated in the fixing roller 11 and the pressure roller 12 is controlled by the control unit (CPU) in accordance with the output of both of the thermistors. In the present embodiment, the fixing temperature of the fixing roller 11 is set to be 180° C. and the fixing temperature of the pressure roller 12 is set to be 150° C. Then, the control unit controls the temperature to be maintained at the abovementioned.

The fixing device 10 of the present embodiment is configured to perform a process to fix the toner image on the recording sheet which is conveyed from the secondary transfer portion onto the recording sheet by heating and pressing at the fixing nip.

Further, the temperature (separation temperature) of the recording sheet at the time of being discharged from the fixing device 10 (i.e., the fixing nip) is maintained at high temperature (i.e., approximately 90° C. to 110° C.). Namely, the fixing device 10 of the present embodiment adopts a high-temperature separation method in which the recording sheet is separated from the fixing device right after passing through the fixing nip.

Here, in the above, the fixing device which utilizes the pair of rollers is described as an example. However, it is also possible to configure to utilize a belt at least either of the fixing side and the pressure side.

(Clear Image Forming Apparatus)

In the present embodiment, an increase in glossiness of the image is achieved by additionally forming a clear toner image on the image surface of the recording sheet by the clear image forming apparatus 20 in a mode of additional forming of a high glossiness image on the recording sheet.

An image forming station (second image forming means) T is provided at the upper part of the clear image forming apparatus 20. The image forming station T forms the clear toner image (i.e., the second toner image) with clear toner (i.e., colorless toner).

The clear image forming apparatus 20 having a fixing belt (i.e., an intermediate transfer member) 21 includes a photosensitive drum 201, a preliminary heating roller (i.e., preliminary heating means) 22, a heating roller 23, a pressure roller 24 and a cooling roller (i.e., cooling means) 25 around the fixing belt 21 along the rotation direction thereof.

The heating roller 23 and the pressure roller 24 serve as second transfer means and form a fixing nip while sandwiching the fixing belt 21. Similar to the abovementioned image forming station Y, a charge roller 202, an exposure unit 203, a development device 204, a primary transfer roller 206 and a cleaner 205 are arranged around the photosensitive drum 201.

A registration roller 28 and the fixing nip are arranged in order from the upstream side in the recording sheet conveying direction.

The development device 204 which develops a toner image with clear toner uses two-ingredient developer including clear toner and a carrier. Here, the clear toner is made of thermoplastic resin as same as the color toner and is substantially colorless clear toner without including color pigment. Similar to the color toner, the clear toner with a glass transition temperature (Tg) is 65° C. is used. Here, it is also possible to use single ingredient developer without including a carrier.

The fixing belt 21 functions as an image bearing member for bearing the clear toner image formed on the photosensitive drum 201 and a function as the fixing member for fixing the toner image transferred on the fixing belt 21 onto the recording sheet P by heating the toner image.

In the present embodiment, the fixing belt 21 is made of thermosetting resin of polyimide etc. as a base. However, other heat-resistant resins are also possible to be used. Then, a silicon rubber layer which is heat-resistant is formed on the base as the elastic layer. Here, fluororubber is also possible to be used instead of the silicon rubber. Further, a fluororesin layer is formed on the silicon rubber layer as the toner parting layer.

When the fixing belt 21 is too thin, the strength thereof is insufficient. On the contrary, when the fixing belt 21 is too thick, the required heat amount for heating the fixing belt 21 is large and there may be a risk that heating and melting the toner is insufficient for fixing. In the present embodiment, the thickness of the fixing belt 21 is set to be within a range between 100 μm and 300 μm.

When electric resistance of the fixing belt 21 is high, there may be a risk that splashing of the toner image and transfer failure are caused due to charge-up with the transfer charging. In this case, charge removal means of the fixing belt 21 is required. Therefore, volume resistancity of the fixing belt 21 is set to be $1\times10^{13}\Omega\cdot$cm or below and surface resistancity thereof is set to be $1\times10^{15}\Omega/\square$ or below. The resistance was measured under the condition of 23° C. and 50% according to JISK6911 using an ultra-high resistance meter Advantest R8340 with a main electrode of which outer diameter being ϕ50 mm and a guard electrode of which inner diameter being ϕ70 mm. Then, regarding the measurement conditions, applying voltage was 100 V and charge time was 60 seconds.

In the present embodiment, the volume resistancity is set to be $5\times10^{8}\Omega\cdot$cm and the surface resistancity is set to be $1\times10^{11}\Omega/\square$ by forming the silicon rubber layer of 100 μm thickness on polyimide of 80 μm thickness so that the total thickness is to be 200 μm with coating of PFA on the surface.

Surfacing of the fixing belt 21 exceedingly affects finishing of the output image. When the surface roughness is small, scratches on the surface of the fixing belt 21 are apt to appear on the image. On the contrary, when the surface roughness is large, the sufficient gloss of the output image may not be obtained. The belt of which 60° glossiness based on the measurement method of specular glossiness of JISZ8741 is approximate 40 to 60% and of which surface roughness Rz based on the surface texture of JISB0601 is approximate 1 μm is adopted in the present embodiment.

The fixing belt 21 is rotatably looped over the preliminary heating roller 22, the heating roller 23 and the cooling roller 25. In the present embodiment, the heating roller 23 has a function as the drive roller to drive the fixing belt 21.

The preliminary heating roller 22 is configured to have a hollow shaft which is made of high heat conductive metal. A halogen heater serving as a heating source is provided inside the preliminary heating roller 22. A thermistor 601 as detection means which detects temperature of the fixing belt 21 at the vicinity of the preliminary heating roller 22 is provided at the vicinity of the outer surface of the fixing belt 21 opposed to the preliminary heating roller 22. A control unit (CPU) 600 controls the temperature of the fixing belt 21 at the part being looped over the preliminary heating roller 22 to be constant by varying powering to the halogen heater based on the output of the thermistor 601.

The heating roller 23 is a hollow roller which has a configuration where a rubber layer serving as the elastic layer is provided on a core bar which is made of high heat conductive metal. It is also possible to simply be a metal roller without having the rubber layer. Specifically, the core bar is formed of an aluminum hollow pipe of 44 mm diameter and 5 mm thickness. The rubber layer is formed of silicon rubber of which JIS-A hardness is 50 degrees and of which thickness is 300 μm. A halogen heater as a heating source is provided inside the heating roller 23. As the heating source, it is also possible to adopt a so-called IH type which utilizes electromagnetic induction heating, for example.

Further, a thermistor as detection means which detects temperature of the fixing belt 21 is provided at the vicinity of the outer surface of the fixing belt 21 opposed to the heating roller 23. The control unit (CPU) 600 controls the temperature of the fixing belt 21 at the part being looped over the heating roller 23 to be constant at 130° C. by varying powering to the halogen heater based on the output of the thermistor. Here, by setting the temperature of the heating roller 23 low to some extent, glossiness increasing and hot offset which are caused by re-melting of the toner image on the recording sheet P subjected to the fixing process by the fixing device 10 can be prevented.

The pressure roller 24 is rotatably arranged at a position opposed to the heating roller 23 while sandwiching the fixing belt 21. The pressure roller 24 is configured to be driven by the fixing belt 21.

The pressure roller 24 is a hollow roller which has a configuration where a rubber layer serving as the elastic layer is provided on a core bar which is made of metal. The rubber layer is formed of silicone rubber of which thickness is 3 mm. In the present embodiment, a heating source such as a halogen heater is provided inside the pressure roller 24 as well and performs heating of a media along with the heating roller 23. As the heating source, other types such as a so-called IH type which utilizes electromagnetic induction heating can be also used.

The pressure roller 24 is pressed with pressure of 50 kg (i.e., 490 N) in total while sandwiching the fixing belt 21 with the heating roller 23. Namely, the pressure roller 24 has a function to form a nip with the fixing belt 21 therebetween. The length of the fixing nip along the recording sheet conveying direction (i.e., the nip width) is set to be 5 mm.

Further, a thermistor serving as detection means which detects temperature of the pressure roller 24 is provided at the vicinity of the outer surface of the pressure roller 24. The control unit (CPU) 600 controls the temperature of the pressure roller 24 to be maintained at 90° C. by varying powering to the halogen heater based on the output of the thermistor.

A cooling device 26 and the cooling roller 25 are provided opposed to the fixing belt 21 at the downstream side of the heating roller 23.

The cooling device 26 has a cooling fan and the fixing belt 21 is cooled by the cooling fan.

The cooling roller 25 through which air is passing so as to be cooled to lower temperature thereof cools the fixing belt 21 which is looped over the cooling roller 25.

The cooling capabilities of the cooling device 26 and the cooling roller 25 are set to the temperature at which the toner and the photosensitive drum are not affected by the heat until the fixing belt 21 arrives at the transfer portion. In the present embodiment, it is set so that the temperature of the fixing belt 21 after passing through the cooling roller 25 is to be 50° C. or below.

Here, the cooling methods of the cooling device 26 and the cooling roller 25 are not limited to the abovementioned example. It is also possible to configure the apparatus to perform cooling by contacting a heat pipe which accommodates a refrigerant such as water, a heat sink, a Peltier element or the like. Further, it is also possible to arrange the cooling device at both surfaces of the fixing belt 21 so that the fixing belt 21 is cooled from both the surface sides.

Figure 7:
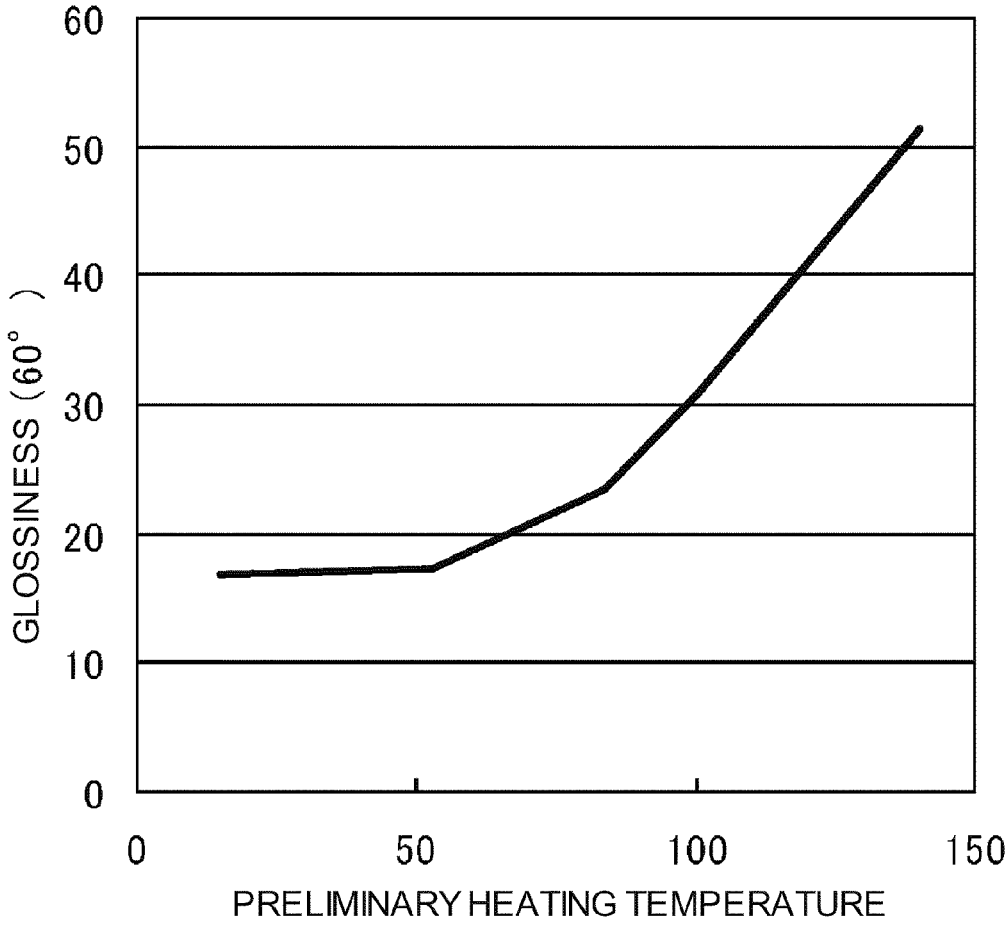
FIG. 7 is a graph which illustrates the relation between heating temperature and glossiness.

The preliminary heating roller 22 heats the toner image bore at the fixing belt 21 to a set temperature (i.e., the preliminary heating temperature) within a range of the temperature at which the hot offset of the toner occurs or below and of the glass transition temperature (Tg) or over. FIG. 7 illustrates the relation between the temperature of the preliminary heating roller 22 and the 60° glossiness of the clear toner image which is fixed on the recording sheet P. As illustrated, the glossiness of the clear toner after fixing can be varied by varying the preliminary heating temperature.

(Operation of Clear Image Forming Apparatus)

Next, the operation of the clear image forming apparatus 20 is described.

When the recording sheet P of which temperature is approximate 70° C. by being subjected to the fixing process of the fixing device 10 is introduced to the clear image forming apparatus 20, the recording sheet P is to be on standby at the registration roller 28.

Both of the photosensitive drum 201 and the fixing belt 21 are operated (i.e., rotated) at the process speed of approximate 130 mm/sec.

The clear toner image which is formed on the photosensitive drum 201 with a process similar to that of the abovementioned full-color image forming portion is transferred to the surface of the fixing belt 21 by applying transfer bias of approximate 20 μA to the transfer roller 206 at the transfer portion.

[Varied Gloss Mode (1)]

In the varied gloss mode (1), the preliminary heating roller 22 is set to be maintained at 70° C. Then, the heating roller 23 and the pressure roller 24 are controlled at 130° C. at the fixing nip. Since the paper surface temperature at sheet-passing is approximate 100° C. which is sufficiently lower than the temperature of 180° C. at which the hot offset occurs.

The fixing belt 21 is heated to the temperature Tg or higher when passing through the preliminary heating roller 22, specifically to approximate 70° C., so that the clear toner image is gently melted and softened. Accordingly, even though the temperature of the heating roller 23 is set to be relatively low, fixing can be performed on the recording sheet P since the clear toner is gently melted with the preliminary heating by heating up to the temperature Tg or higher.

The recording sheet P is fed to the fixing nip by the registration roller 28 which is driven in synchronization with a position of the clear toner image on the fixing belt 21.

The clear toner image is not sufficiently melted on the fixing belt 21 and is thermally transferred to the recording sheet P mainly by the heat of the heating roller 23. Accordingly, the toner image of low glossiness is formed. At that time, the glossiness of the color toner image part is approximate 30% and the glossiness of the clear toner part is approximate 20%. In this manner, a pattern of which glossiness is partially approximate 10% lower than that of a previously formed part can be formed in a full color image on a recording sheet. Accordingly, an area at which the clear toner image is formed with the image forming station T can be formed of the desired glossiness.

[Varied Gloss Mode (2)]

In the varied gloss mode (2), the preliminary heating roller 22 is set to be maintained at 120° C. Then, the heating roller 23 and the pressure roller 24 are set to be 130° C. as same as the varied gloss mode (1).

The fixing belt 21 is heated to the temperature Tg or over when passing through the preliminary heating roller 22, specifically to approximate 120° C., so that the clear toner image is melted and softened. Accordingly, even though the temperature of the heating roller 23 is set to be relatively low, the clear toner image can be fixed on the recording sheet P.

The clear toner image which is sufficiently melted on the fixing belt 21 forms a smooth and high-glossiness toner image along the surface texture of the fixing belt 21 when thermally transferred to the recording sheet P. At that time, the glossiness of the color toner image part is approximate 30% and the glossiness of the clear toner image part is approximate 40%. In this manner, a pattern of which glossiness is approximately 10% higher than that of a previously formed part can be formed in a full color image on a recording sheet.

[Uniform Gloss Mode]

In the uniform gloss mode, the preliminary heating roller 22 is set to be maintained at 100° C. Then, the heating roller 23 and the pressure roller 24 are set to be 130° C. as same as the varied gloss mode (1) and the varied gloss mode (2).

The fixing belt 21 is heated to the temperature Tg or higher when passing through the preliminary heating roller 22, and specifically to approximate 100° C., so that the clear toner image is intermediately melted and softened. The clear toner image which is intermediately melted on the fixing belt 21 is transferred to the recording sheet P. Accordingly, the glossiness of both the color toner image part and the clear toner image part is approximate 30%. In this manner, a pattern of which glossiness is almost the same as that of a previously formed part can be formed in a full color image on a recording sheet.

[Operation of Image Forming Apparatus]

Figure 3:
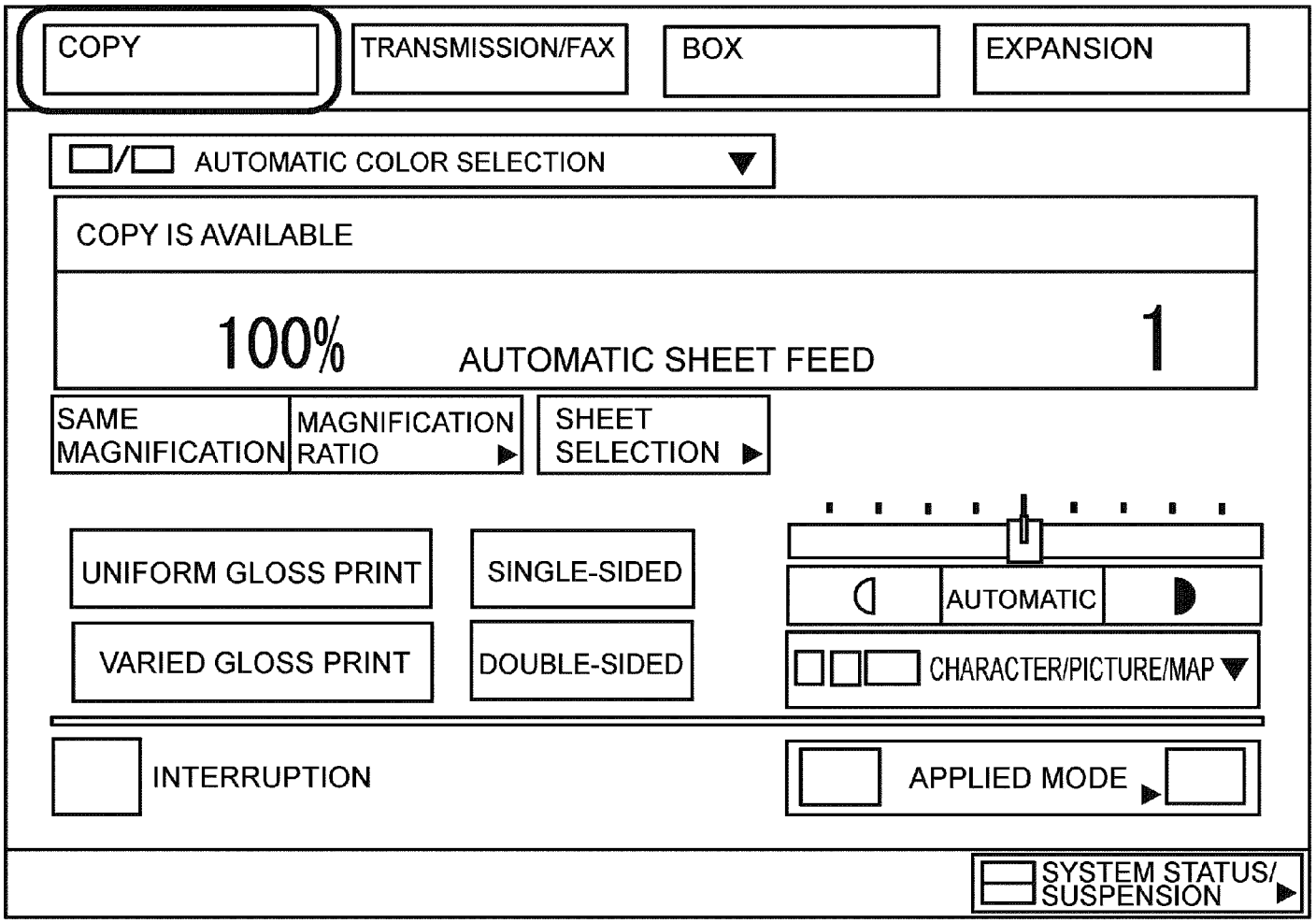
FIG. 3 is an explanatory diagram of an operation screen of an operation portion of the image forming apparatus.
Figure 4:
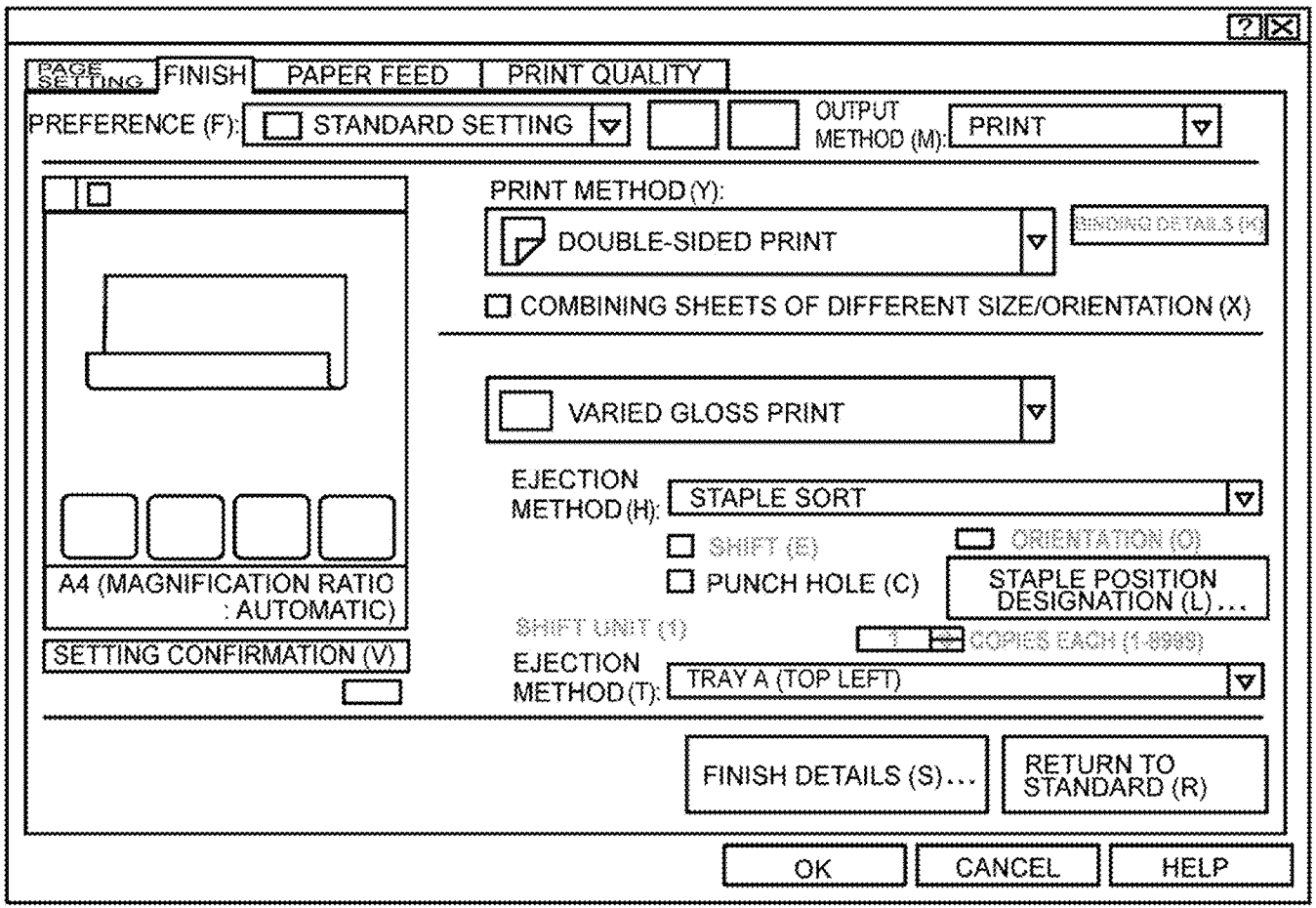
FIG. 4 is an explanatory diagram of an operation screen of a printer driver.

The operation of the image forming apparatus is performed by designating "Varied gloss print" or "Uniform gloss print" on an operation screen of the operation portion 400 of the image forming apparatus which is illustrated in FIG. 3 or by a printer driver screen of a personal computer which is illustrated in FIG. 4. With this operation, it is selected whether or not the clear image forming apparatus 20 is operated. The set temperature of the preliminary heating roller 22 is variable corresponding to the designated print mode.

In the case where either the varied gloss print or the uniform gloss print is designated, the recording sheet P is discharged to a passage A after passing through the fixing nip. In the case where neither the varied gloss print nor the uniform gloss print is designated, the recording sheet P is discharged to a passage B without passing through the fixing nip.

Second Embodiment

Next, the image forming apparatus and the image forming method of the second embodiment according to the present invention are described with reference to the drawings. The same reference numeral is given to each part which is used in the first embodiment and the description thereof is omitted.

Figure 2:
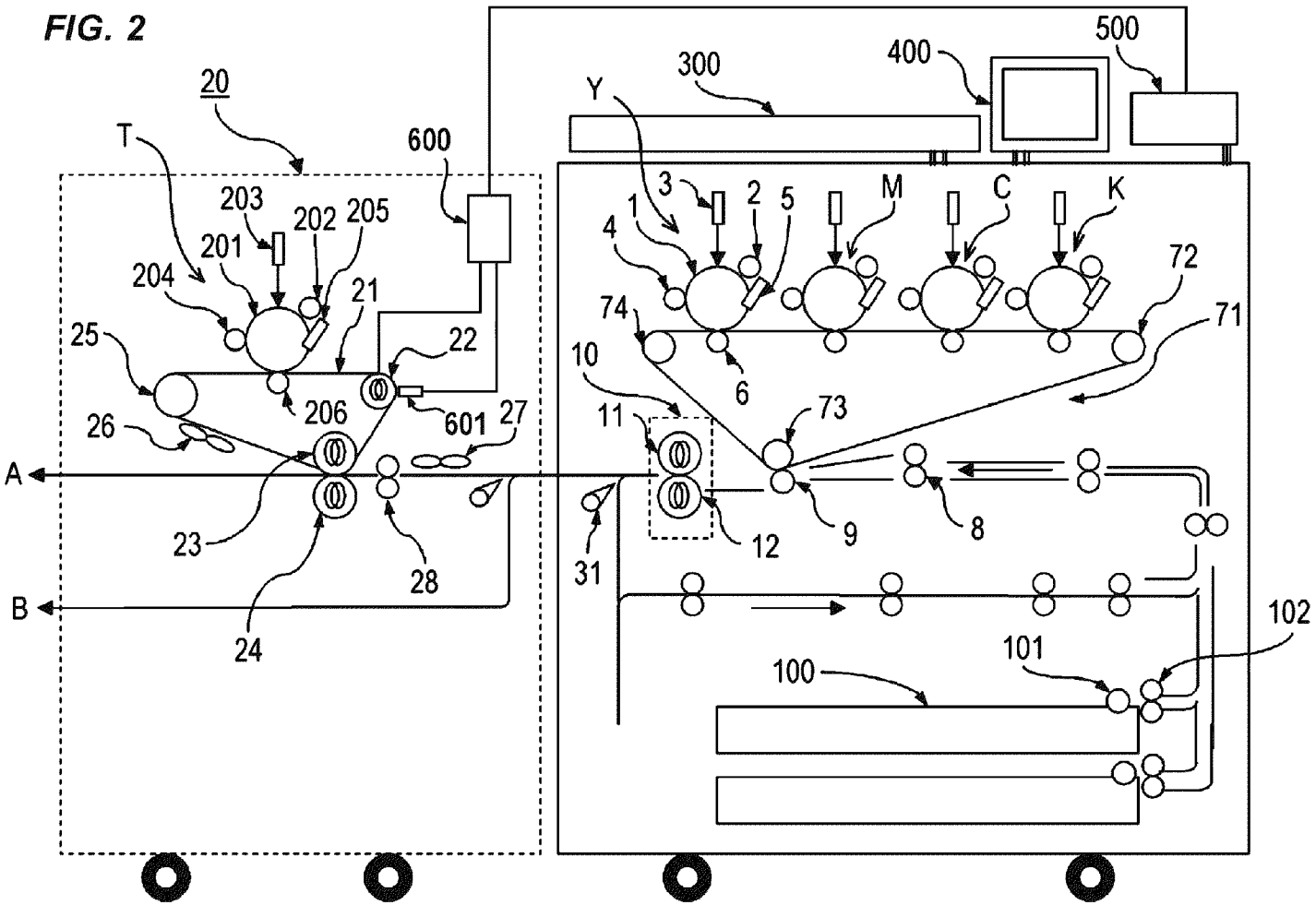
FIG. 2 is a configuration diagram of an image forming apparatus according to a second embodiment.

FIG. 2 is a configuration diagram of the image forming apparatus according to the present embodiment. As illustrated in FIG. 2, in the image forming apparatus of the present embodiment, a cooling fan (i.e., cooling means) 27 is provided to the conveyance passage between the fixing device 10 and the fixing nip of the heating roller 23 and the pressure roller 24 of the first embodiment.

In the fixing process of the full color image forming portion, the amount of heat added to the recording sheet P increases in accordance with conditions such as thick paper fixing and double-sided paper fixing. Accordingly, the temperature of the recording sheet P which is to be introduced to the clear image forming apparatus 20 becomes high after full color image forming is performed. In this case, there is a risk that the glossiness becomes too high or the hot offset occurs due to re-melting of the full color image when passing through the heating roller 23.

In the present embodiment, the recording sheet P is cooled by the cooling fan 27 before being conveyed to the fixing nip. Here, the full color toner image which is already fixed on the recording sheet P is cooled to the temperature sufficiently lower than the glass transition temperature (Tg) of the toner, specifically cooled to approximate 50° C. or below. Here, since the full color toner image is partially softened and melted at the fixing nip but not thoroughly, the glossiness is not increased. Further, the hot offset at the full color toner image is also prevented.

Third Embodiment

Next, the image forming apparatus and the image forming method of the third embodiment according to the present invention are described with reference to the drawings. The same reference numeral is given to the part which is used in the first embodiment and the description thereof is omitted.

Figure 5:
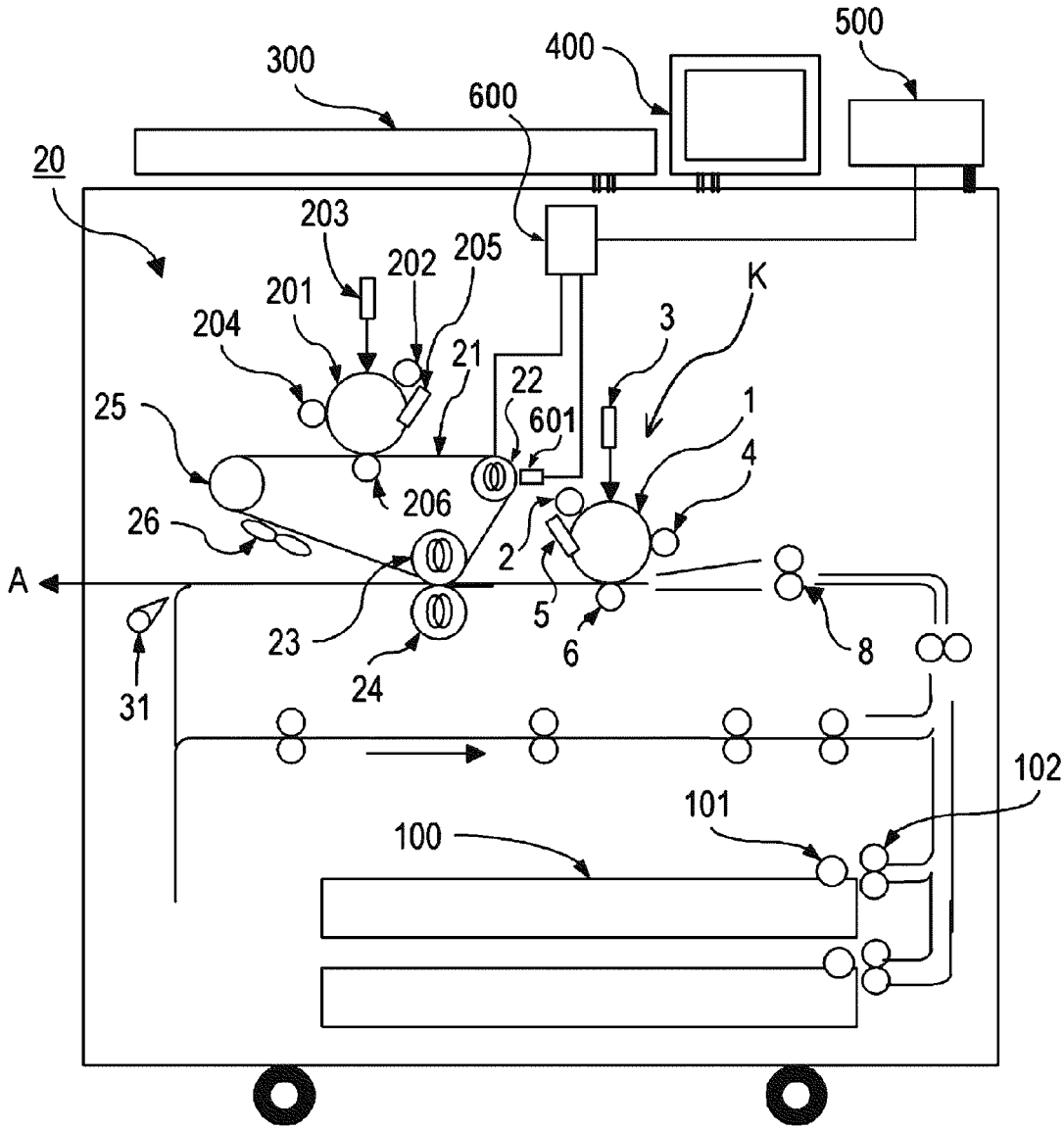
FIG. 5 is a configuration diagram of an image forming apparatus according to a third embodiment.

FIG. 5 is a configuration diagram of the image forming apparatus according to the present embodiment. As illustrated in FIG. 5, in the image forming apparatus of the present embodiment, a single color image forming apparatus which utilizes black toner and a clear image forming apparatus are integrated. An image forming portion of black color is provided instead of the full color image forming portion and the fixing belt 21 of the first embodiment. Then, a black toner image is transferred directly to the recording sheet P. The process speed of every image forming unit is set to be approximate 130 mm/sec.

The fixing device is not provided after forming of the black toner image, and, instead, the black toner the clear toner are collectively fixed at the fixing portion of the clear image forming apparatus. Accordingly, the temperature of the heating roller 23 is set to be 180° C. so that the black toner can be fixed, and then, the temperature of the pressure roller 24 is set to be 150° C. and the temperature of the preliminary heating roller 22 is set to be 100° C.

In the present embodiment, the toner which is similar to that used in the first embodiment is sufficiently softened and melted at the abovementioned setting, and then, the hot offset does not occur.

With the abovementioned configuration, the clear toner which is heated by the preliminary heating roller 22 is melted more than the black toner so that the glossiness is increased after being fixed. Accordingly, an output product having gloss difference compared to an area of only black toner can be obtained.

Figure 8:
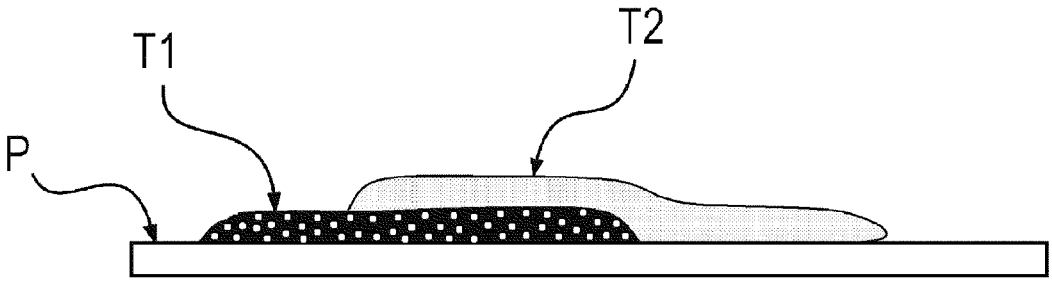
FIG. 8 is an explanatory diagram of a toner configuration on a recording sheet surface.

As described above, with the image forming of the present embodiment, the clear toner T2 is formed onto the color toner T1 on the recording sheet P as illustrated in FIG. 8. Accordingly, a pattern of which glossiness is different from that of the color toner T1 can be formed with the clear toner T2.

Fourth Embodiment

Next, the image forming apparatus and the image forming method of the fourth embodiment according to the present invention is described with reference to the drawing. The same reference numeral is given to the part which is used in the first embodiment and the description thereof is omitted.

Figure 6:
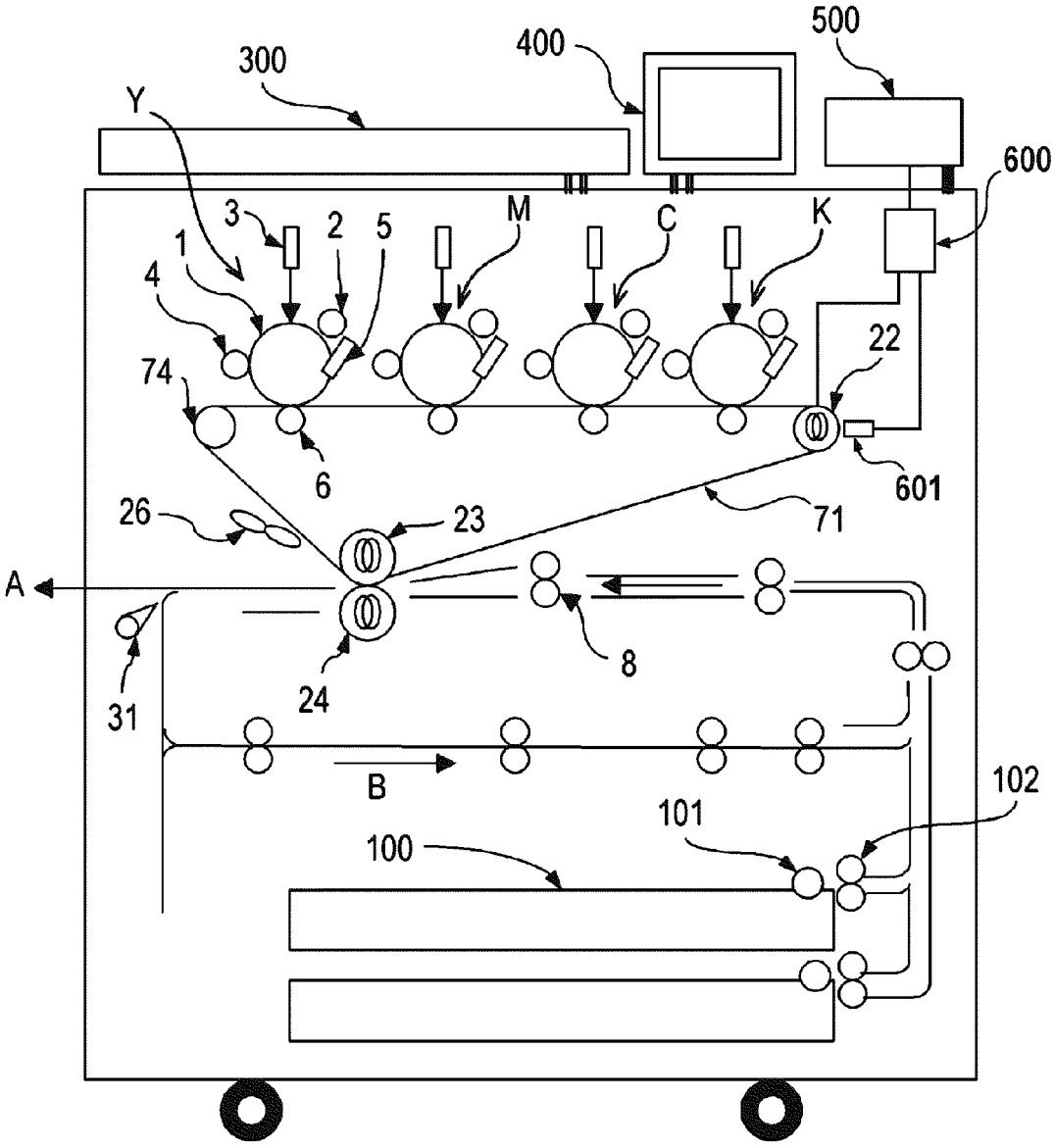
FIG. 6 is a configuration diagram of an image forming apparatus according to a fourth embodiment.

FIG. 6 is a configuration diagram of the image forming apparatus according to the present embodiment. As illustrated in FIG. 6, the image forming apparatus of the present embodiment is a full color printer which uses toner of four colors. In the image forming apparatus of the present embodiment, the clear image forming apparatus 20 and the fixing device 10 are eliminated from the first embodiment. Here, the preliminary heating roller 22 is provided instead of the driven roller 72 and the heating roller 23 is provided instead of the secondary transfer counter roller 73, and then, the pressure roller 24 is provided instead of the secondary transfer roller 9.

In the image forming apparatus of the present embodiment, a plurality of images are thermally transferred to the same surface of the recording sheet P being divided into plural times. The heating temperature of the toner images which are bore at the intermediate transfer belt 71 at the respective thermal transfer processes can be set independently.

The processes until forming the toner image on the photosensitive drum 1 and primarily transferring to the intermediate transfer belt 71 is similar to those of the full color image forming apparatus of the first embodiment. The intermediate transfer belt 71 is looped over the preliminary heating roller 22 and the heating roller 23. The primarily transferred toner image is heated and melted by the preliminary heating roller 22 on the intermediate transfer belt 71 and thermally transferred to the recording sheet P by the heating roller 23 and the pressure roller 24. Here, the temperature of the heating roller 23 is set to be 180° C. and the temperature of the pressure roller 24 is set to be 150° C.

[Uniform Gloss Mode]

In the uniform gloss mode, the preliminary heating roller 22 is set to be maintained at 100° C. Accordingly, the toner image which is primarily transferred on the intermediate transfer belt 71 is thermally transferred to the recording sheet P after being softened and melted.

[Varied Gloss Mode]

In the mode to form an image which has glossiness difference, first, the recording sheet P on which an image is formed under the conditions similar to those of the uniform gloss mode is conveyed to a passage (re-conveyance passage) C via conveyance passage switching means 31. Then, the recording sheet P on which the toner image is transferred is conveyed to the fixing nip once more and image forming is performed once more on the same surface of the recording sheet P.

At that time, the toner image which is primarily transferred on the intermediate transfer belt 71 is thermally transferred to the recording sheet P after being sufficiently softened and melted by maintaining the temperature of the preliminary heating roller 22 at 120° C. which is different from the set temperature at the first thermal transferring of the toner image.

In this manner, the image of which glossiness is higher than that of the previously (i.e., firstly) formed toner image can be formed to overlap on the previously (i.e., firstly) formed toner image.

On the other hand, by maintaining the temperature of the preliminary heating roller 22 at 70° C., the toner image which is primarily transferred on the intermediate transfer belt 71 can be thermally transferred to the recording sheet P without being melted so much. In this manner, the image of which glossiness is lower than that of the previously (i.e., firstly) formed toner image can be formed to overlap on the previously (i.e., firstly) formed toner image.

In the present embodiment, the cooling means is not provided to the recording sheet conveyance passage. However, it is also possible to prevent a poor image forming at the time of the second fixing by cooling the recording sheet on the recording sheet conveyance passage as needed, as described in the second embodiment.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-197157, filed Jul. 31, 2008, which is hereby incorporated by reference herein in its entirety.

What is claimed is:

1. An image forming apparatus comprising:

a first toner image forming portion which forms a toner image on a recording material and heats the recording material on which the toner image is formed;

a second toner image forming portion which forms a toner image on the recording material heated at the first toner image forming portion and heats the recording material on which the toner image is formed, the second toner image forming portion including an image bearing member for bearing the toner image and a transfer member for transferring the toner image of the image bearing member to the recording material; and a preliminary heating member which heats the toner image on the image bearing member of the second toner image forming portion before transferring operation of the transfer member.

2. The image forming apparatus according to claim 1, wherein the preliminary heating member heats the toner image on the image bearing member to a temperature of or greater than a glass transition temperature of the toner.

3. The image forming apparatus according to claim 2, wherein the second toner image forming portion heats the toner image which is to be transferred to the recording material at an area in which the toner image on the image bearing member is transferred to the recording material by the transfer member.

4. The image forming apparatus according to claim 1, further comprising:

an operation portion for selecting glossiness of the toner image on the recording material which is heated at the second toner image forming portion; and varying means which varies temperature of the preliminary heating member in accordance with the glossiness selected at the operation portion.

5. The image forming apparatus according to claim 1, wherein the first toner image forming portion forms a toner image with color toner and the second toner image forming portion forms a toner image with clear toner.

* * * * *